United States Patent [19]

Nishikawa

[11] 4,285,025

[45] Aug. 18, 1981

[54] CORONA CHARGER

[75] Inventor: Masaji Nishikawa, Hachioji, Japan

[73] Assignee: Olympus Optical Company Ltd., Tokyo, Japan

[21] Appl. No.: 42,972

[22] Filed: May 25, 1979

[30] Foreign Application Priority Data

May 31, 1978 [JP] Japan ..... 53-64378

[51] Int. Cl.[3] ..... H01T 19/00

[52] U.S. Cl. ..... 361/230; 361/235

[58] Field of Search ..... 361/229, 230, 235; 250/324–326

[56] References Cited

U.S. PATENT DOCUMENTS

| | | | |
|---|---|---|---|
| 3,470,417 | 9/1969 | Gibbons | 250/326 X |
| 3,527,941 | 9/1970 | Culhane et al. . | |
| 3,843,906 | 10/1974 | Leibrecht . | |
| 4,088,892 | 5/1978 | Plumadore | 250/325 |

*Primary Examiner*—Harry E. Moose, Jr.

*Attorney, Agent, or Firm*—Haseltine and Lake

[57] ABSTRACT

A corona charger for improving efficiency of utilizing the corona charging current and being able to effect high speed and uniform charging by providing an additional grid electrode applied with a bias voltage between the other grid electrode so as to accelerate the passing of the corona ion stream through openings of the grid electrodes.

7 Claims, 16 Drawing Figures

CORONA CHARGER

BACKGROUND OF THE INVENTION

1. Field of the Invention

The present invention relates to a corona charger or a corona charging apparatus used, for instance, in an electro-photographic device. A corona charger is used for charging a photoconductive layer or a dielectric layer in such an electro-photographic device. In such a case, the characteristic of the corona charger generally requested is to charge the objective surface to be charged up to a predetermined potential as quick as possible. Furthermore, there is a requirement to charge the objective surface as uniform as possible. More particularly, the present invention relates to an improved corona charger having efficient and quick charging characteristics for obtaining a uniform charged surface.

2. Description of Prior Art

FIG. 1-A shows diagrammatically a traditional corona charger known as a "corotron" charger. This charger substantially comprises a corona wire 1 and a shield electrode 2 arranged to surround the corona wire 1. A high voltage of a desired potential is applied to the corona wire 1 by means of an electric voltage source 3. In this specification, the explanation will be made for a case that the corona wire is charged in positive polarity. The shield electrode 2 is connected to the ground potential together with a conductive layer 5 provided beneath the objective surface 4 to be charged and forming a back up electrode. A corona discharge is produced by an electric field produced between the high electric voltage of the corona wire 1 and the ground potential shield electrode 2. A part of the corona discharge current flows toward the objective surface 4 and charges it. While this traditional corona charger is able to make a high speed charging and it is said as high efficiency, this type of charger has a disadvantage in that it is difficult to charge the objective surface uniformly at a predetermined potential.

Namely, this type of charger is not equipped with a control means for the potential of the objective surface. Accordingly, the charged potential may vary by the voltage variation of the electric source 3 or by the variation of environmental condition such as moisture, atmospheric pressure or others. Furthermore, non-uniform charging of the objective surface arises when dust or rust is attached or existed on the corona wire 1.

In order to solve such disadvantage of the traditional device, a corona charger equipped with a grid electrode for controlling the charging potential had been proposed. This charger is called as "scorotron" and the essential diagram is shown in FIG. 1-B. This charger comprises a grid electrode 6 arranged at a surface where the corona ions are produced. The grid electrode 6 is applied with a predetermined bias voltage by a voltage source 7. In such a construction, if the objective surface is charged at a potential corresponding to said bias voltage, there will be no electric field potential between the grid electrode 7 and the objective surface 4 and the charging of the surface 4 is discontinued. Accordingly, by charging the objective surface 4 by producing a sufficient amount of the corona discharge, the objective surface can be charged uniformly at a predetermined potential which corresponds to said bias voltage. By this means, resulting of non-uniform charging or variation of charging potential due to voltage variation of the corona current source, variation of moisture, atmospheric pressure or by the presence of dust on the corona wire can be avoided. However, this device has a disadvantage in that a considerable amount of the corona ions are caught by the grid electrode and unable to pass the grid electrode and hence the efficiency of utilizing the corona ion current becomes very low.

By the above reason, this device is not suited for use in a high speed charging device. Moreover, since this type of device required to employ a high power corona discharge so that there was another disadvantage in that a poisonous gas such as ozone is produced in large amount.

FIG. 1-C shows behavior of the electric field and the corona ion stream around the grid electrode 6. As can be seen from this schematic illustration, a large amount of ion stream besides those passing through the opening 8 of the grid 6 shown by dotted lines is caught by the grid electrode 6 as shown by full line.

FIG. 1-D is another embodiment of a conventional device to improve abovementioned disadvantage. This embodiment comprises modified shaped grid electrode 9 applied with an insulating layer 10 on the surface facing to the corona wire 1. This construction of grid had been disclosed on the Japanese opened patent publication No. 137,345/77. In this construction when the corona discharge is started, the insulating layer 10 is also charged and an electric field from the insulating layer 10 toward the layer shaped grid electrode is formed. Due to presence of this electric field, the corona ion stream easily passes the gap between the grid electrodes and the utilizing efficiency of the corona ion current can be improved.

However, in this recently proposed construction, as the electric field for accelerating the passing of the corona ion stream between the grid wires 9 is produced by charging the insulating layer 10 by the corona ion stream, there are still disadvantages in that the charging of the objective surface becomes non-uniform due to a difference of the electric field for accelerating the passing of the corona ion stream in the following occasions.

(a) When the thickness of the insulating layer 10 is non-uniform.

(b) When there is non-uniformity in the corona ion stream produced from the corona wire 1.

It is obvious that this disadvantage may be avoided by using sufficiently long charging time so as to charge the objective surface 4 to have a same uniform potential with that applied to the grid electrode layer 9 even at the most weak charging point. However, by this practice, one of the object to improve the efficiency of the corona charger cannot be achieved.

Furthermore, in the conventional charging devices, since another electric field for the corona discharge exists between the corona wire 1 and the corona shield plate 2, a considerably large amount of the corona ion current flows towards the shield plate 2 which does not contribute the charging of the objective surface 4 and this causes also deterioration of the charging efficiency.

SUMMARY OF THE INVENTION

The present invention has for its object to realize a high efficiency corona charger being able to obtain a very speedy and uniform charging up to a predetermined potential of the objective surface and being not influenced by the variation of the source voltage and environmental conditions such as moisture and existence of dust on the corona wire and further not producing poisonous gas such as ozone.

The charger according to the present invention comprises a corona wire, a corona shield member having an opening facing to the objective surface to be charged, a grid electrode provided in said opening, a means for applying corona discharge voltage for said corona wire, and a means for applying a bias voltage with said grid electrode, and it is characterized in that a separate grid electrode is arranged in parallel and adjacent to said grid electrode, and a means for applying a bias voltage between the two grid electrodes is provided so that an electric field is formed therebetween to accelerate corona ion stream of desired polarity to easily pass through said grid electrodes.

DESCRIPTION OF THE PREFERRED EMBODIMENT

Figure 1A:
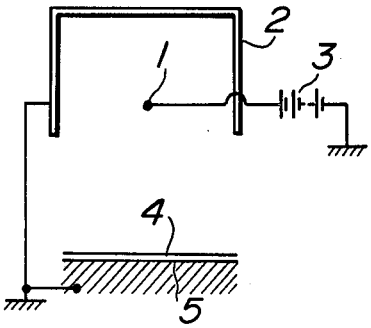
FIG. 1A PRIOR ART
FIG. 1-A is a diagrammatic illustration of a conventional corona charger called corotron, FIG. 1-B is a diagram showing the principle of a conventional charger called scorotron, FIG. 1-C is a diagram for showing flow line of ion stream around the grid electrode in a conventional scorotron charger, FIG. 1-D is a diagram for showing an improved embodiment of a conventional scorotron charger shown in FIG. 1-B, FIG. 2-A is a diagrammatic illustration for showing general construction of the scorotron charger made in accordance with the present invention, FIG. 2-B is a diagram for showing the flow of the corona ion stream and the electric field around grid electrode of the charger made in accordance with the present invention, FIGS. 3-A and 3-B are perspective views for showing construction of the grid electrodes of the charger of the present invention, FIGS. 4-A and 4-B are end views of other embodiment of the grid electrodes of the present invention, FIGS. 5-A, 5-B, 5-C and 5-D show various manners for applying the bias voltage for the grid electrodes, and FIGS. 6-A and 6-B show an embodiment of the present invention in which the corona shield member is formed of insulating material so as to improve the efficiency of utilizing the corona ion current.
Figure 1B:
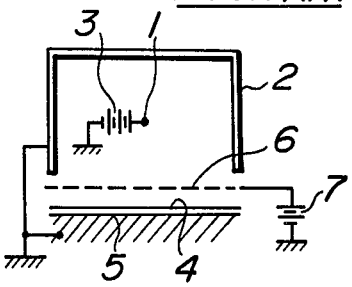
FIG. 1B PRIOR ART
Figure 1C:
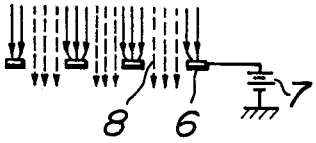
Figure 1D:
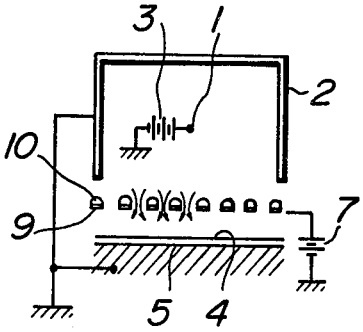
FIG. 1D PRIOR ART

The first embodiment of the present invention will be described by referring to FIG. 2-A. This charger comprises a corona wire 1 and a corona shield electrode 2 just as same as the conventional charger. According to the present invention, two sets of grid electrodes 11 and 12 are provided at an opening of the corona shield electrode 2. One of said grid electrodes facing to the objective surface, in this case grid electrode 11 is applied with a bias voltage corresponding to the desired charging potential by means of a bias source 7 and another electrode 12 is applied with a potential higher than said bias voltage by means of an additional bias source 13.

Figure 2A:
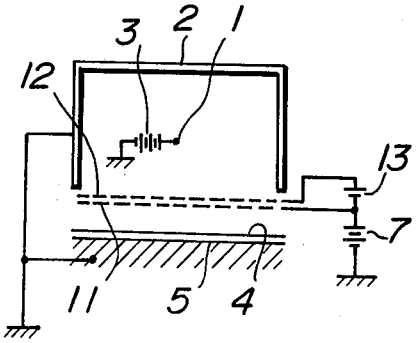
Figure 2B:
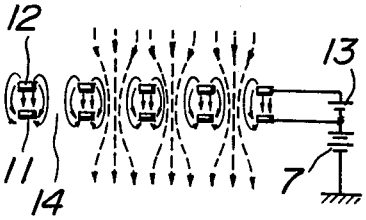

FIG. 2-B is a diagram for showing the shape of corona ion stream and the electric field around the grid electrodes. In the present embodiment, the grid electrodes 11 and 12 are made in an identical configuration so that the electric field produced has the shape shown by the full line extending from the electrode 12 to the electrode 11 as shown in FIG. 2-B. By this electric field, the corona ion stream flowed from the corona wire 1 as shown by the dotted lines is accelerated by this electric field and may pass the openings between the grid electrodes very easily. This can be explained further as follows. Although the corona ion stream shown by the dotted line passing through the openings is narrowed, the velocity is much higher by the accelerating effect so that the total amount of ions passing through the openings increases substantially. This is just corresponding to a case as if the surface area of the openings has increased. Accordingly, the utilizing efficiency of the corona stream is materially improved. The corona ion stream passed through the openings is attracted by the bias electric field applied by the bias voltage source 7 between the grid 11 and the backup electrode 5 and is landed on to the objective surface and charges it. The charging is carried until a time when the charged potential of the objective surface becomes nearly equal to the potential of the grid electrode 11. This is same as the conventional charger.

Figure 3A:
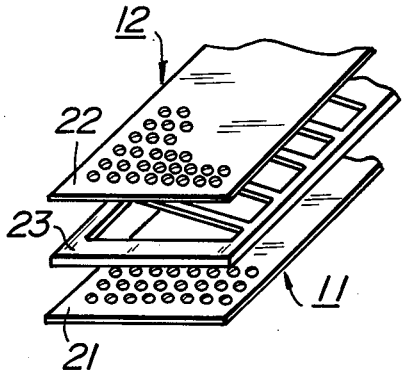
Figure 3B:
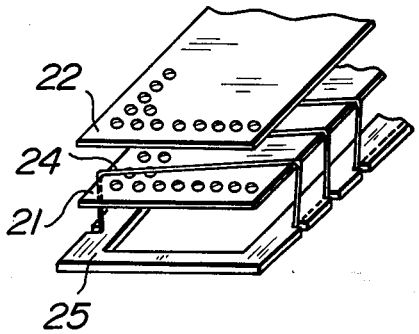

FIGS. 3-A and 3-B show one embodiment of providing two grid electrodes 11 and 12 arranged very closely. The two grid electrodes are formed of metal plates 21 and 22 having a great number of openings provided by punching or etching. The diameter of the opening of the grid electrodes and the pitch thereof are determined from the distance between the grid electrode and the objective surface and also in view of easiness in the manufacture. As for an example, the pitch between the openings is preferably made shorter than the distance between the grid electrode and the objective surface. This distance between the grid electrode and the objective surface is preferably made shorter in view of realizing a strong electric field therebetween. In practice, the distance between the grid electrode and the objective surface is better to be selected about 1 mm to 5 mm. Accordingly, the diameter of the openings and the pitch therebetween should be made less than few millimeters.

FIG. 3-A shows one embodiment of arranging two identical grid electrodes 11 and 12 worked as mentioned above at a predetermined distance with an interposition of a punched out insulative spacer 23. FIG. 3-B shows another embodiment of arranging the two grid electrodes 21 and 22 with an interposition of a spacer of a string like member 24. These elements are assembled by using a frame member 25.

Figure 4A:
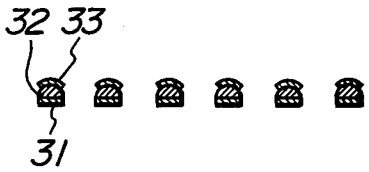
Figure 4B:
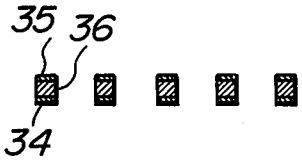

FIGS. 4-A and 4-B show an embodiment for forming the two grid electrodes and the interposed spacer integrally. According to this embodiment of the invention, the openings of the two grid electrodes and that of the spacer can be made coincident more perfectly.

FIG. 4-A is an embodiment formed by applying an insulating layer 32 by spraying or the like on a metal plate 31 formed with openings being used as the grid electrode 11 and thereafter an electrode 33 is formed thereon by spattering, or electrolytic process or the like to form the grid electrode 12.

FIG. 4-B is an embodiment formed by jointing two metal plates or foils 34 with an interposition of an insulating plate 36 by attaching them on both sides thereof by means of, for instance, adhesive, pressing, electroplating, spattering or the like and thus formed three layer member is worked to have openings by punching or the like. In the practice shown in FIG. 4-B, the both surface print base material used as a general electronic part for wiring can be used for the material of said three layer member. In this case, the material can be obtained in market and it need to be worked only by punching so that this embodiment is convenient for cost saving.

Figures 5A, 5B, 5C, 5D:
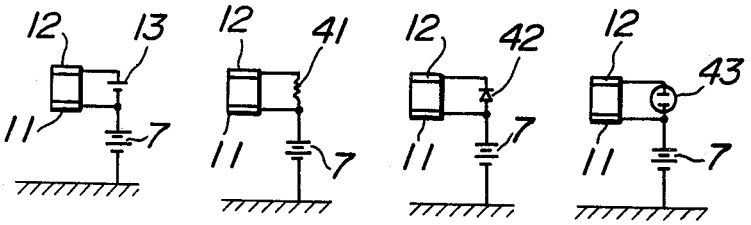

FIGS. 5-A to 5-D show some manners of applying the bias voltage between the two grid electrodes 11 and 12. FIG. 5-A uses a dc voltage source 13 for supplying said bias voltage just as same as that explained with respect to FIG. 2-A. As a similar practice with the above, a single dc source may be used and by means of resistive voltage divider, the two kinds of voltages, i.e. one between the grid electrode 11 and the ground and one between the grid electrode 11 and the grid electrode 12 may be produced.

FIG. 5-B shows a circuit corresponding to a self bias practice, in which a resistor 41 is connected between the grid electrodes 11 and 12. In this arrangement, the corona ion current coming in to the electrode 12 flows through this resistor 41 and a bias voltage corresponding to the voltage drop across the resistor is used as the bias voltage.

FIG. 5-C is a case of using a zener diode 42 in place of the resistor 41 in FIG. 5-B to produce a certain bias voltage between the electrodes 11 and 12. FIG. 5-D is a case of using a neon lamp or a discharge gap 43 to be used as a constant voltage discharge device in place of the zener diode 42 in FIG. 5-C.

Instead of connecting the resistor 41 outside the electrodes 11 and 12, the spacer between the electrodes 11 and 12, for instance, the insulating plate 36 in FIG. 3-B may have a function same as the resistor 41. In practice, a suitable conductive material for decreasing the resistance of the insulating material, for instance, metal powders, carbon granules, particles of metal oxides or the like may be included in the insulator of the separator to lower the resistance value. Further, a semiconductive material such as Se, which suddenly decreases the resistance according to an increase of the applied voltage may be used as the spacer.

Figure 6A:
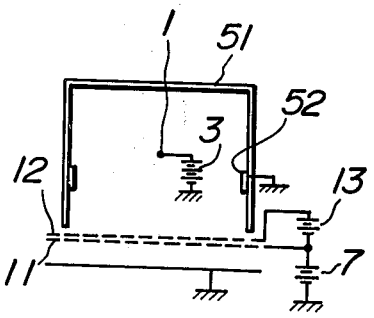
Figure 6B:
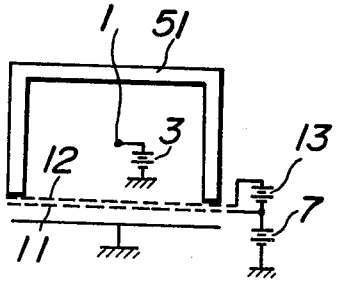

FIGS. 6-A and 6-B show schematically other embodiments of the charger of the present invention for making further improvement of the corona stream using efficiency. In FIG. 6-A, the corona shield 51 covering the corona wire 1 is formed of an insulating material and the electric field required for obtaining the corona discharge is formed by ground connecting a belt shaped metal plate 52 provided on a portion of the corona shield 51. In such a construction, the non-working corona ion current flowing towards the corona shield member in the device and which does not act as the charging current may be decreased and the corona ion current utilizing efficiency can be improved remarkably.

FIG. 6-B is a case in which the corona shield 51 is formed of an insulating material and the electric field required for the corona discharge is formed between the grid electrode 12 and the corona wire 1. In this case as there is no corona ion current flowing to the corona shield, the utilizing efficiency of the corona current can be improved further. In the conventional corona charger, in which the electric field for corona discharge is formed between the corona shield and the corona wire, the non-effective corona current flowing towards the corona shield is amounted some several times to several tens times larger than the effective corona current used for charging the objective surface. Accordingly, the improvement in the utilizing efficiency of the corona current by the embodiments shown in FIGS. 6-A and 6-B for decreasing the non-effective corona ion current is quite remarkable. This will contribute for miniaturization of the corona current source and preventing the production of the poisonous gas such as ozone or the like.

The present invention is not to be limited only for the aforementioned embodiments. For instance, the shape of the openings in the grid electrode may be any of rectangular, ellipsoidal or polygonal or the like besides the round shape. The arrangement of the openings may be any manner so far as it is able to charge the objective surface uniformly.

Further in the embodiment shown in FIG. 5-A, according to the bias voltage applied to the grid electrodes 11 and 12, the grid electrodes may have rectifying function to accelerate the electric charges in one polarity to pass the openings and to prohibit the passing of charges in other polarity so that the corona wire may be applied with an ac voltage and the charger may function same as a dc charger. When a conductive material is used for corona shield, a suitable bias voltage may be applied to the corona shield instead of grounding it so as to decrease the non-effective corona current further.

According to the present invention, the efficiency of utilizing the corona current can be improved and a uniform charging is effected so that a corona charger is able to charge in high speed and having a merit of producing less poisonous gas can be realized.

What is claimed is:

1. A corona charger comprising a corona wire, a corona shield member having an opening facing to the objective surface to be charged, a grid electrode having a number of small openings and provided in said opening, a means for applying corona discharge voltage to said corona wire, and a means for applying a bias voltage to said grid electrode, wherein: a separate grid electrode is provided having substantially identical configuration with said grid electrode and arranged in parallel and adjacent to said grid electrode, so that the small openings of the two grid electrodes are aligned together with respect to corona ion stream, and a means for applying a bias voltage between the two grid electrodes is provided so that an electric field is formed therebetween to accelerate corona ion stream of desired polarity to easily pass through said grid electrodes.

2. A corona charger as claimed in claim 1, wherein the two grid electrodes have substantially identical configuration and being separated by an insulative separator.

3. A corona charger as claimed in claim 2, wherein the two grid electrodes are joined together with interposition of a plastic layer forming the separator.

4. A corona charger as claimed in claim 1, wherein the means for applying the bias voltage between the two grid electrodes is a resistor to form self bias.

5. A corona charger as claimed in claim 1, wherein the means for applying the bias voltage between the two grid electrodes is a diode to form self bias.

6. A corona charger as claimed in claim 1, wherein the means for applying the bias voltage between the two grid electrodes is a constant voltage discharge device to form self bias.

7. A corona charger as claimed in claim 1, wherein the corona shield member is made of insulative material.

* * * * *